US006928788B1

(12) United States Patent
Lai

(10) Patent No.: US 6,928,788 B1
(45) Date of Patent: Aug. 16, 2005

(54) TYING MACHINE FOR TYING AN ARTICLE

(76) Inventor: Hung-Jung Lai, No. 305, Sec. 3, Chung-Shan Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 10/911,527

(22) Filed: Aug. 5, 2004

(51) Int. Cl.[7] ..... B65B 7/12
(52) U.S. Cl. ..... 53/138.8; 100/31; 140/93.6
(58) Field of Search ..... 53/138.6, 138.8, 53/583; 100/31; 140/93 A, 93.6

(56) References Cited

U.S. PATENT DOCUMENTS 3,218,779 A * 11/1965 Haddock ..... 53/138.8
3,721,061 A * 3/1973 Bodolay ..... 53/138.8
3,825,039 A * 7/1974 Crabb ..... 140/93 A
4,043,363 A * 8/1977 Tange ..... 53/583
4,054,160 A * 10/1977 Knudsen ..... 53/138.8

* cited by examiner

*Primary Examiner*—John Sipos
(74) *Attorney, Agent, or Firm*—Banner & Witcoff, Ltd.

(57) ABSTRACT

A tying machine for tying an article, such as an open part of a bag, includes an operating member connected to a drive shaft which in turn is connected to a link mechanism. A rack member is connected pivotally to the link mechanism and engages a single-direction gear which drives a rotary shaft and a cam member. The cam member actuates a wire bending unit, a wire cutting unit, and a wire twisting unit. A returning spring is associated with the drive shaft. The operations of the link mechanism and the rack member may be reversed by turning the operating member to rectify malfunctions.

11 Claims, 10 Drawing Sheets

TYING MACHINE FOR TYING AN ARTICLE

BACKGROUND OF THE INVENTION

1. Field of the Invention

This invention relates to a tying machine, more particularly to a tying machine which is operable manually.

2. Description of the Related Art

FIGS. 1 and 2 show a typical tying machine 10 which includes a base body 11, a wire reel 12 mounted on the base body 11 and carrying a wire 20, a support plate 13 disposed at the front of the base body 11 and having a recess 131, and a control switch 14 mounted on the support plate 13, a driving unit 15, an advancing unit 16, a cutting unit 17 and a tying mechanism 18.

The driving unit 15 includes a shaft 152 extending through the support plate 13 and driven by a motor 151, first and second gear discs 153, 154 sleeved around the shaft 152 beneath the support plate 13, a first gearwheel 155 disposed at the bottom side of the support plate 13 and driven by the first gear disc 153, a second gear wheel 156 engaging the first gear wheel 155, a bevel gear assembly 157 passing through the support plate 13 and driven by the second gear disc 154, and a drive wheel 158 mounted on the bevel gear assembly 157.

When the motor 151 is energized, a wire twisting unit 183 of the tying mechanism 18 is driven by the second gear disc 154, an advancing wheel 163 is driven through the second gear wheel 155 to advance the wire 20, and a rotary cam 171 is driven through the shaft 152 to actuate a link 172 so that a hook-like arm 173 is rotated to push the wire 20 to the recess 131. When the rotary cam 171 is rotated, the projecting part thereof pushes a roller 177, and a transmission rod 175 is driven to turn a transverse link 176 which in turn pushes a cutter 179 toward the wire 20 to cut the same. At the same time, the hook-like arm 173 is continuously rotated to cause the wire 20 to surround a bag (not shown) received by the recess 131. Finally, two ends of the cut wire 20 are moved into twisting grooves 182 of the wire twisting unit 183 and are then twisted by the wire twisting unit 183 to tie the opening of the bag.

Although the aforesaid tying machine 10 can achieve its intended functions, it encounters a problem in that malfunctions that occur during the operation of the tying machine is difficult to rectify, because reversal of the operations of the components which are driven by the motor 151 is not easy.

SUMMARY OF THE INVENTION

An object of the present invention is to provide a tying machine which is manually operable and which facilitates rectification of malfunctions so as to maintain a normal operational condition.

According to this invention, a tying machine for tying an article comprises: a machine body having a recess adapted to receive a portion of the article; a wire reel mounted on the machine body and having a wire wound around the wire reel; an advancing unit mounted on the machine body for advancing the wire toward the recess; a wire bending unit mounted on the machine body and including a hook-like arm which is movable toward the recess so as to bend the wire around the article or which is movable away from the recess; a wire cutting unit mounted on the machine body for cutting the wire; a wire twisting unit mounted on the machine body for twisting the wire after the wire is bent; an operating member mounted on the machine body; a drive shaft connected to the operating member so as to be rotated thereby; a link mechanism connected to the rotary shaft; a rack member connected to and driven by the link mechanism; and a transmission unit including a rotary shaft, and a single-direction gear sleeved around the rotary shaft for simultaneous rotation therewith, said single-direction gear being engaged with and driven by the rack member, wherein the wire bending unit, the wire cutting unit, and the wire twisting unit are connected to and driven by the rotary shaft.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
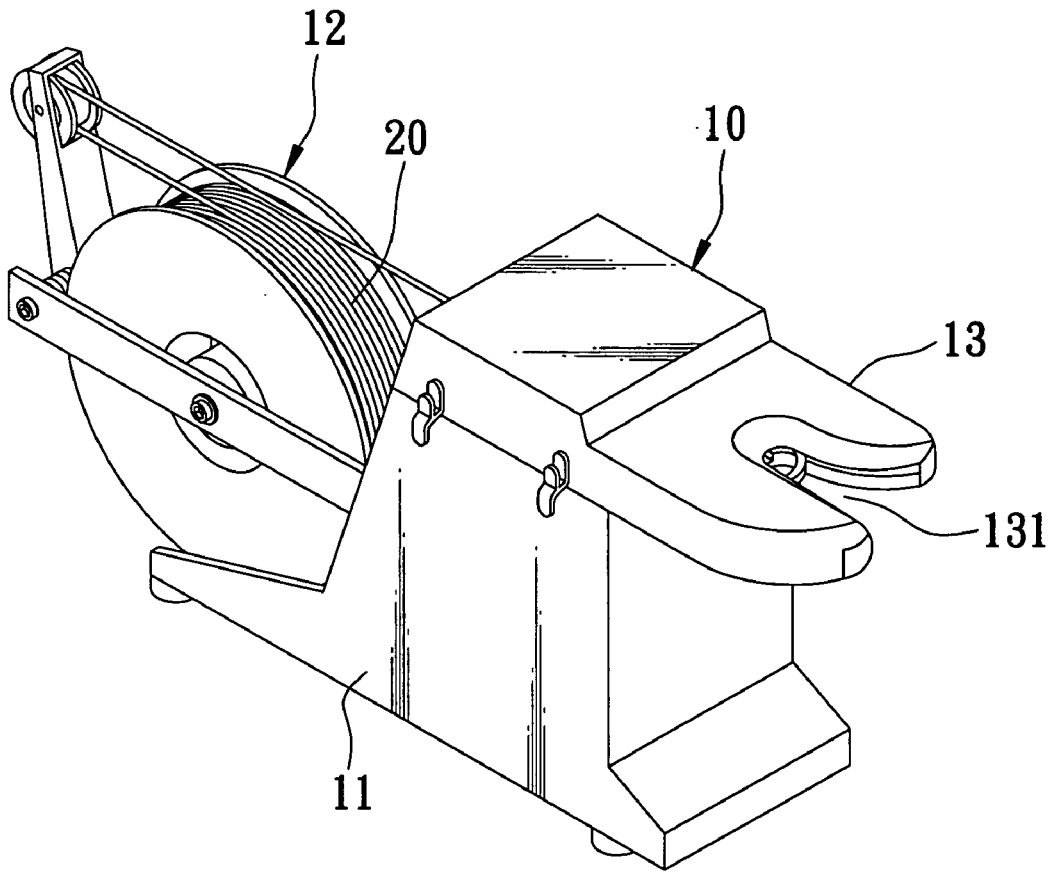
FIG. 1 PRIOR ART
FIG. 1 is a perspective view of a conventional tying machine.
Figure 2:
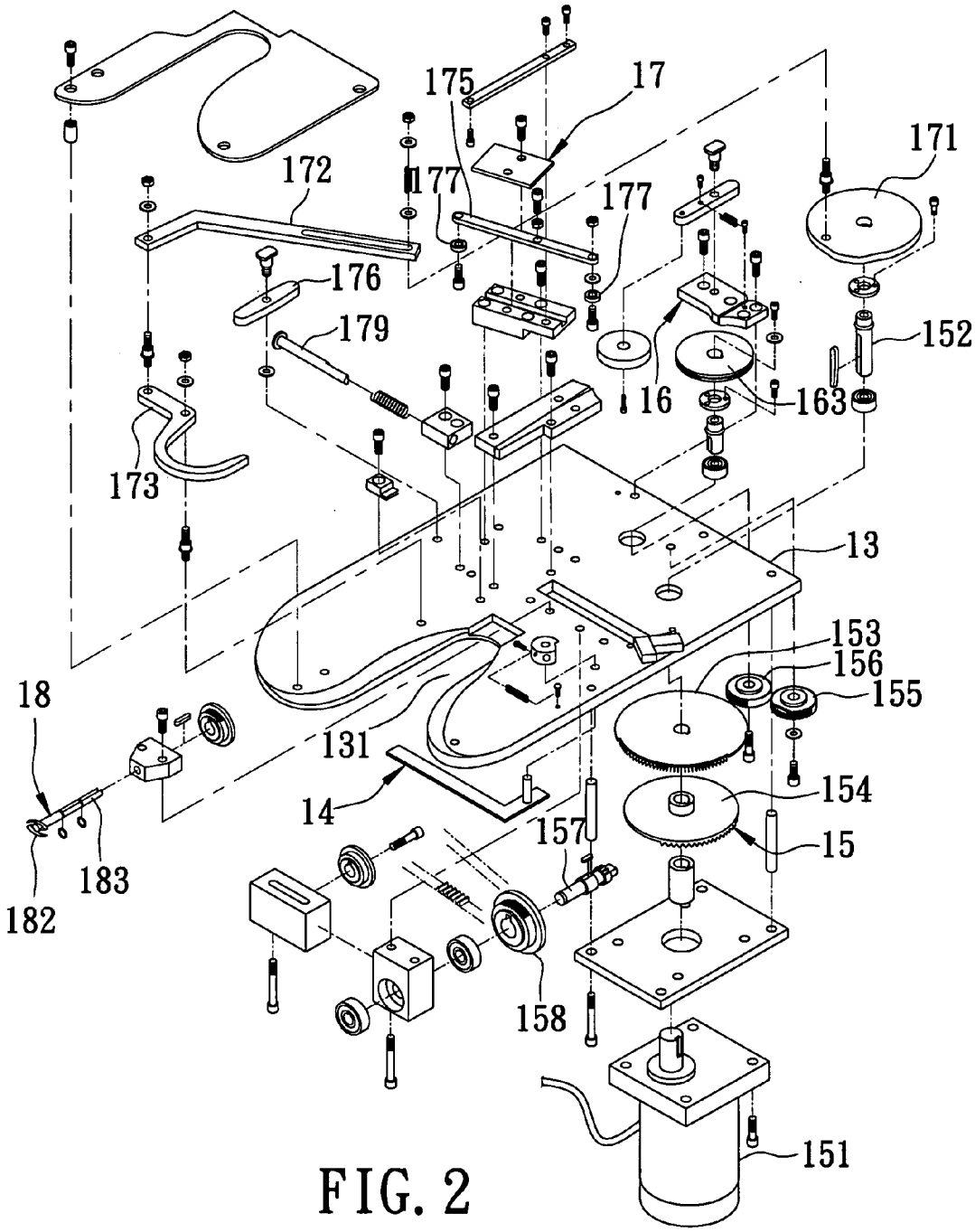
FIG. 2 PRIOR ART
FIG. 2 is an exploded view of a portion of the conventional tying machine.

Referring to FIGS. 3, 4, 5, 6 and 7, a tying machine embodying the present invention is shown to include a machine body 30, a wire reel 40 mounted on the machine body 30 and having a wire 47 wound thereon, a drive mechanism 50, an advancing unit 60 mounted on the machine body 30 to advance the wire 47, and a constricting unit 70 for constricting an article to be tied.

The machine body 30 has a base 31, two spaced-apart first and second side walls 32 and 33 extending upwardly from the base 31, a top wall 34 interconnecting the top ends of the first and second side walls 32 and 33, and a guide seat 35 disposed at the bottom side of the top wall 34 proximate to the second side wall 32. An upper support 36, in the form of a casing, is mounted on top of the top wall 34. The upper support 36 has a partition plate 37 and is covered by a cover 38.

The guide seat 35 has front and rear ends 351 and 352 and has a slide groove 353 which extends from the front end 351 to the rear end 352.

Figure 8:
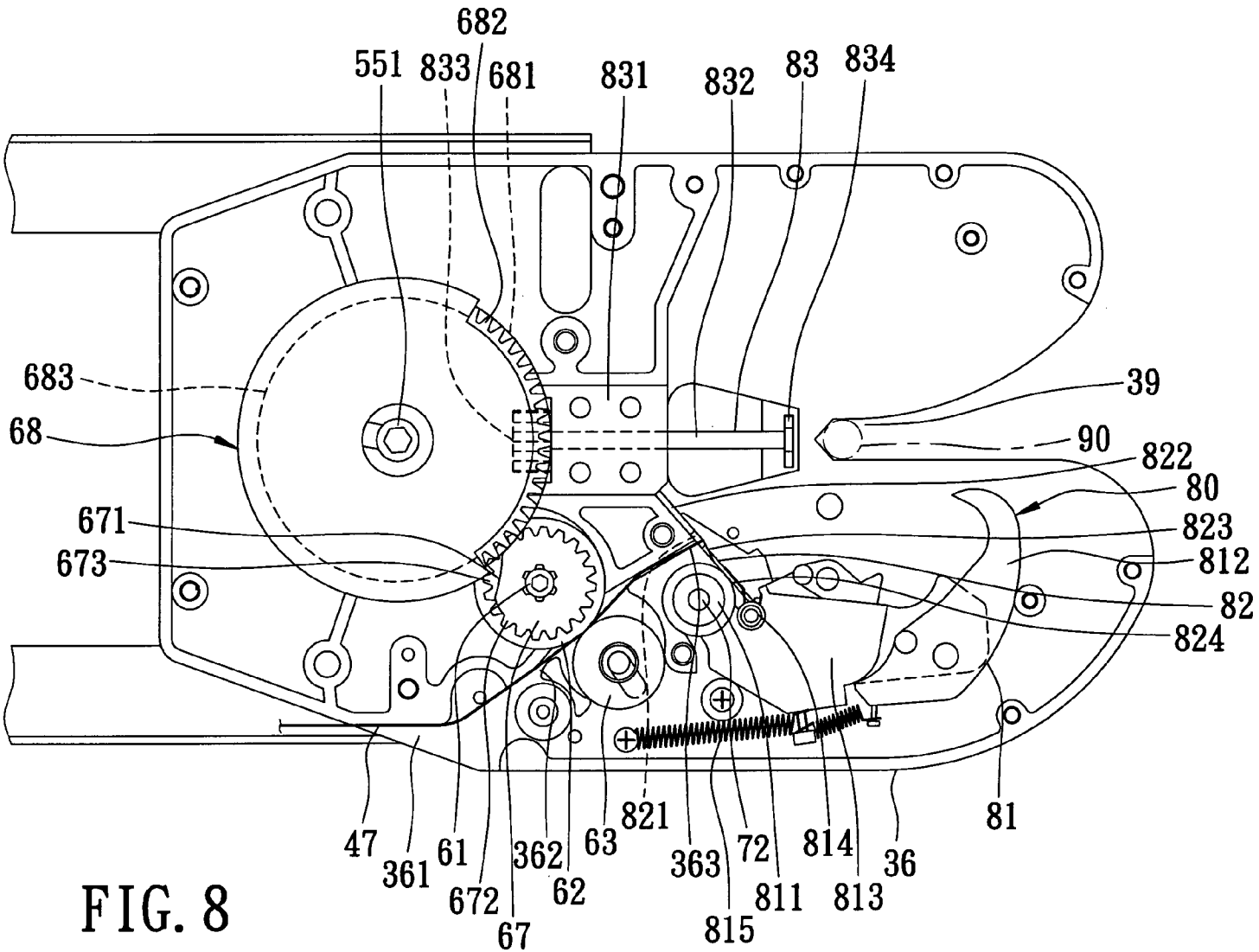
FIG. 8 is a top view of the tying machine with a cover and a partition plate thereof being removed therefrom.

The upper support 36, the partition plate 37 and the cover 38 are notched at their front end to form a recess 39 for receiving a portion of the article to be tied, for instance, an open part of a bag (not shown). As shown in FIG. 8, a wire inlet 361, a wire guide passage 362 and a wire outlet 363 are provided in the upper support 36.

Figure 5:
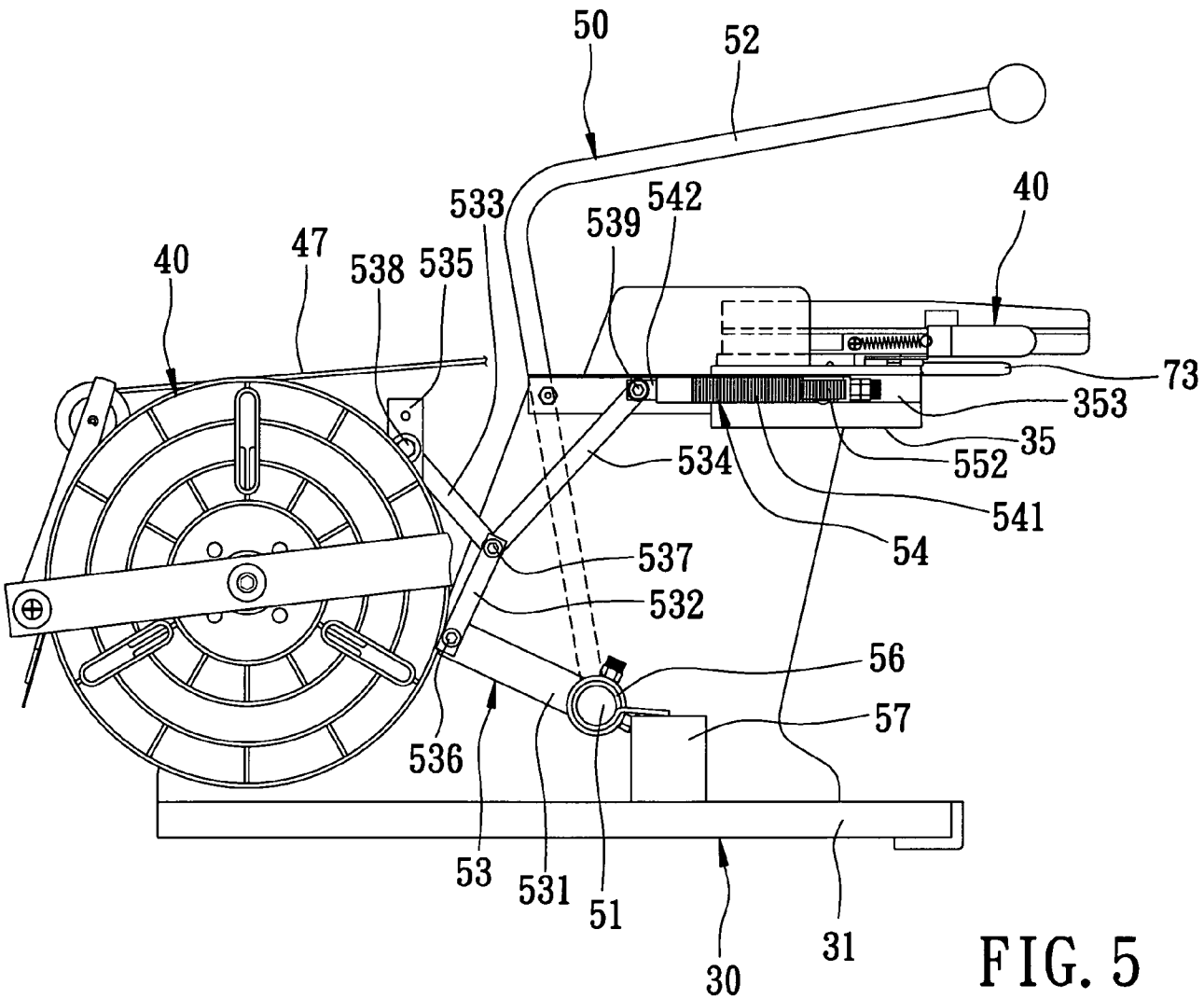
FIG. 5 is the same view as FIG. 3 but with a portion of the tying machine being sectioned.
Figure 6:
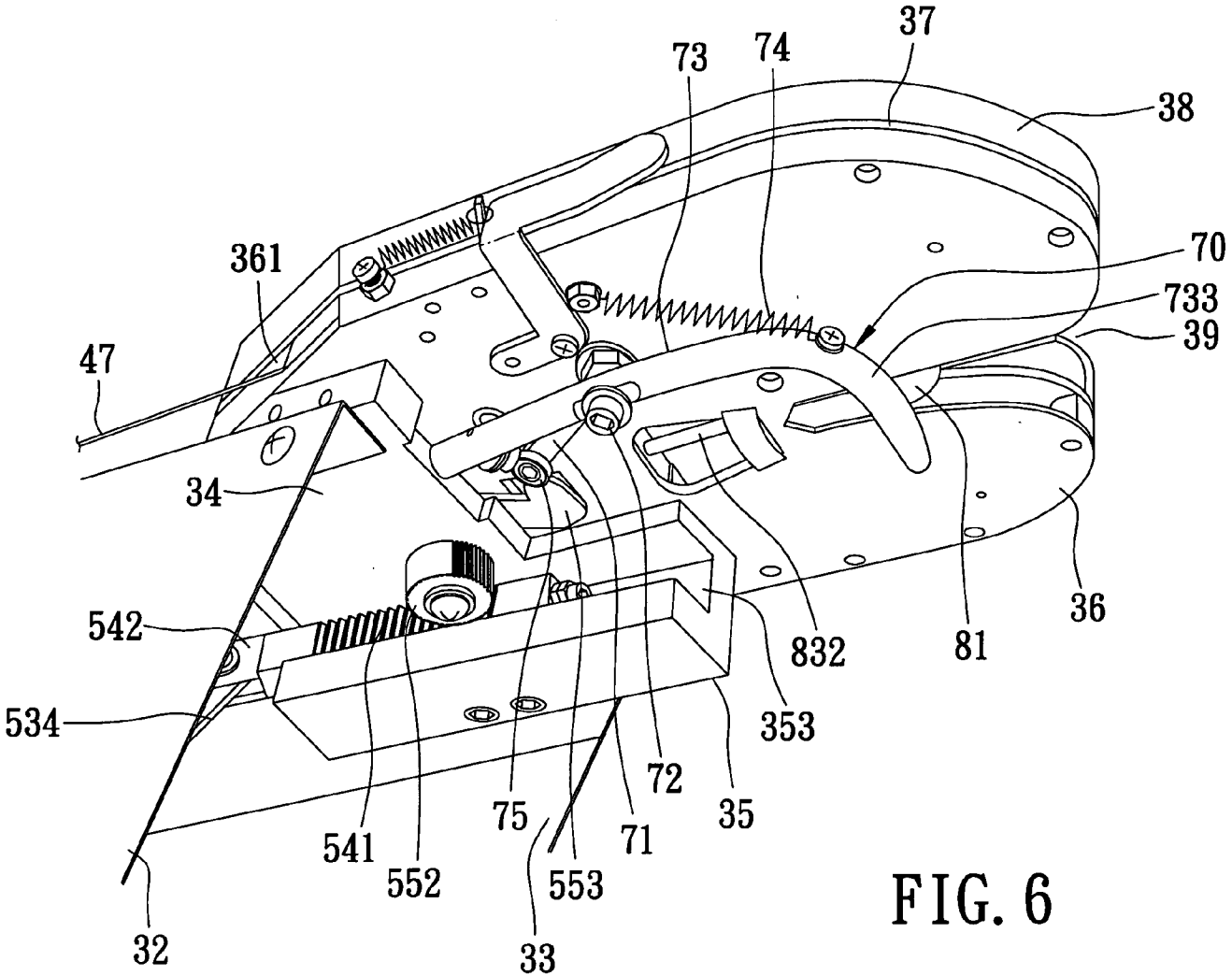
FIG. 6 is a fragmentary perspective view of the tying machine.
Figure 7:
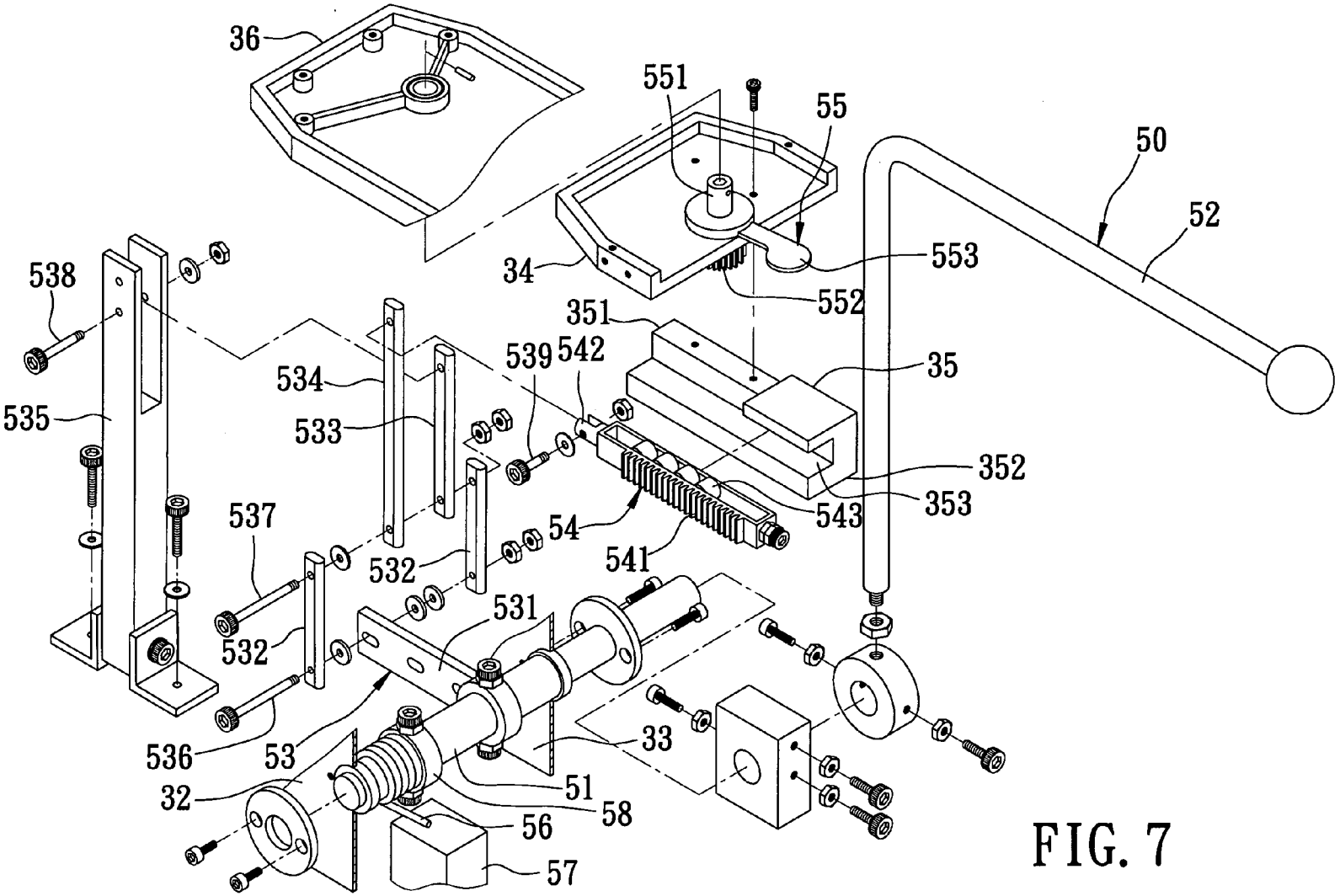
FIG. 7 is an exploded view showing a link mechanism of the tying machine.

Referring to again FIGS. 5, 6 and 7, the drive mechanism 50 includes a drive shaft 51 rotatably disposed between the first and second side walls 32, 33 and having two ends extending through the first and second side walls 32, 33, and an operating member 52 fixed to one end of the drive shaft 51 outwardly of the second side wall 33. A link mechanism 53 is connected to the drive shaft 51 between the first and second side walls 32, 33. A rack member 54 is connected pivotally to the link mechanism 53 and is disposed slidably in the slide groove 353 of the guide seat 35. A transmission unit 55 is mounted on the top wall 34 proximate to the rack member 54. A returning spring 56 is sleeved on the drive shaft 51 to urge the operating member 52 to its original position after the operating member 52 is operated manually.

The link mechanism 53 has a first link 531 connected to the drive shaft 51, two second links 532 connected pivotally to two sides of the first link 531 through a pivot member 536, third and fourth links 533, 534 having ends connected pivotally between the two second links 532 by means of a second pivot member 537, and a fixing rod 535 fixed to the base 31 and pivoted to the third link 533 opposite to the second links 532. The rack member 54 is connected pivotally to the fourth link 534 opposite to the second links 532 through a third pivot member 539.

The rack member 54 has a first side formed with a plurality of rack teeth 541 and is slidably disposed within the slide groove 353. A pivot end 542 extends rearwardly from a rear end of the rack member 54 and is pivoted to the fourth link 534. A plurality of rollers 543 are mounted on the rack member 54 and project outwardly from a second side of the rack member 54 to contact the groove wall of the slide groove 353. Through the rollers 543, the rack member 541 can slide smoothly within the slide groove 353.

The transmission unit 55 has a rotary shaft 551 which passes through the top wall 34, the upper support 36 and the partition plate 37. The lower end of the rotary shaft 551 extends downwardly from the top wall 34. A single-direction gear 552 is sleeved fixedly around the lower end of the rotary shaft 551 at the bottom side of the top wall 34 and is engaged with the rack teeth 541 of the rack member 54. A cam member 553 is mounted on the rotary shaft 551 and disposed on top of the top wall 34. The single-direction gear 552 transmits rotational movement to the rotary shaft 551 when it is rotated in one direction by the rack member 54 and idles when rotated in an opposite direction. The rotary shaft 551 serves to transmit motions to the advancing unit 60, the constricting unit 70, and a tying mechanism for tying an article 90 (see FIG. 8) with the wire 47. The details thereof will be described hereinafter.

The returning spring 56 in this embodiment is a torsion spring sleeved on the drive shaft 51 and has two end legs respectively abutting against a stop ring 58 which is sleeved on the drive shaft 51 and a positioning block 57 which is fixed to the base 31. The returning spring 56 serves to provide a returning force to the drive shaft 51 after the drive shaft 51 is rotated through the operating member 52.

Figure 3:
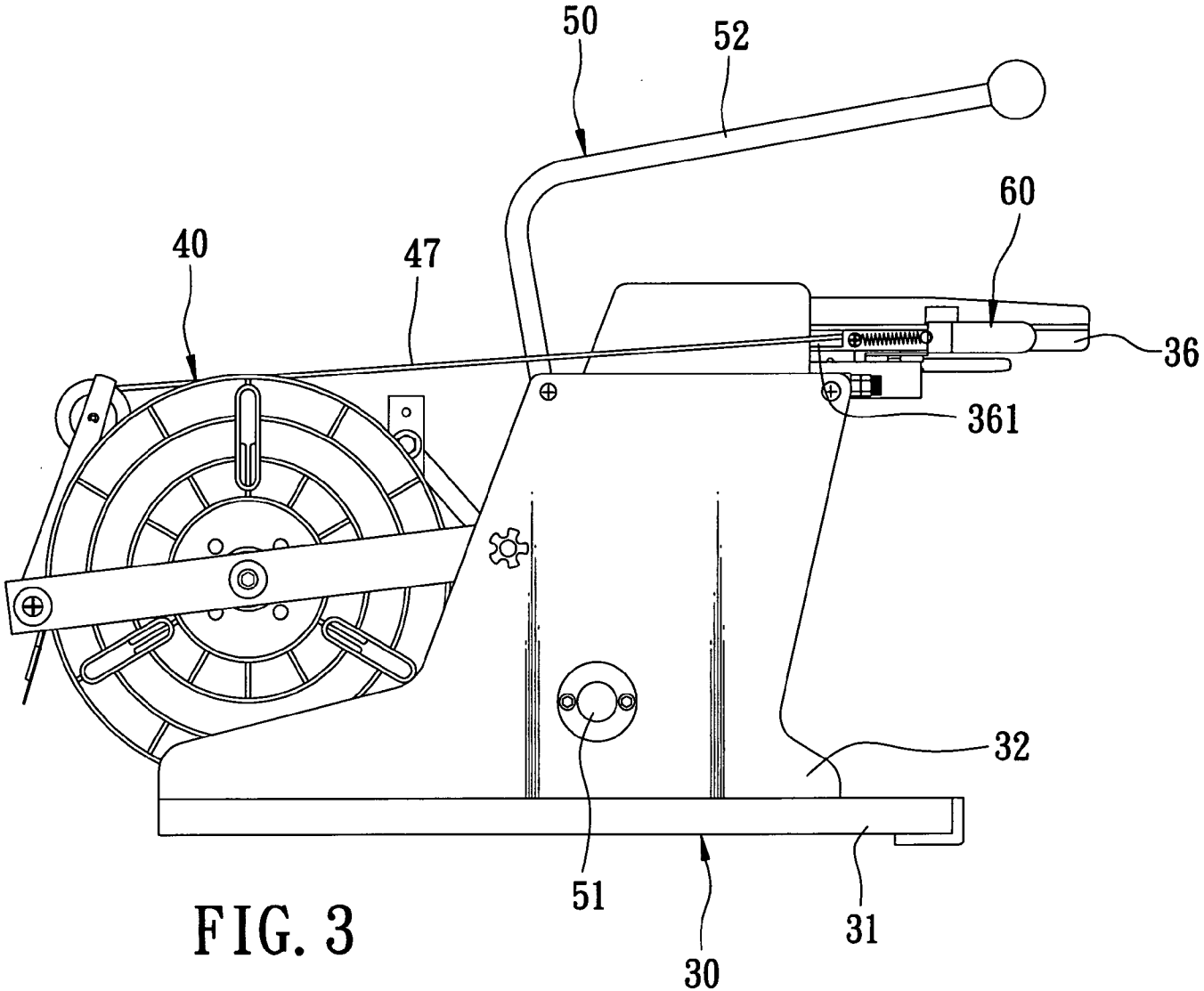
FIG. 3 is a side view of a tying machine embodying the present invention.
Figure 4:
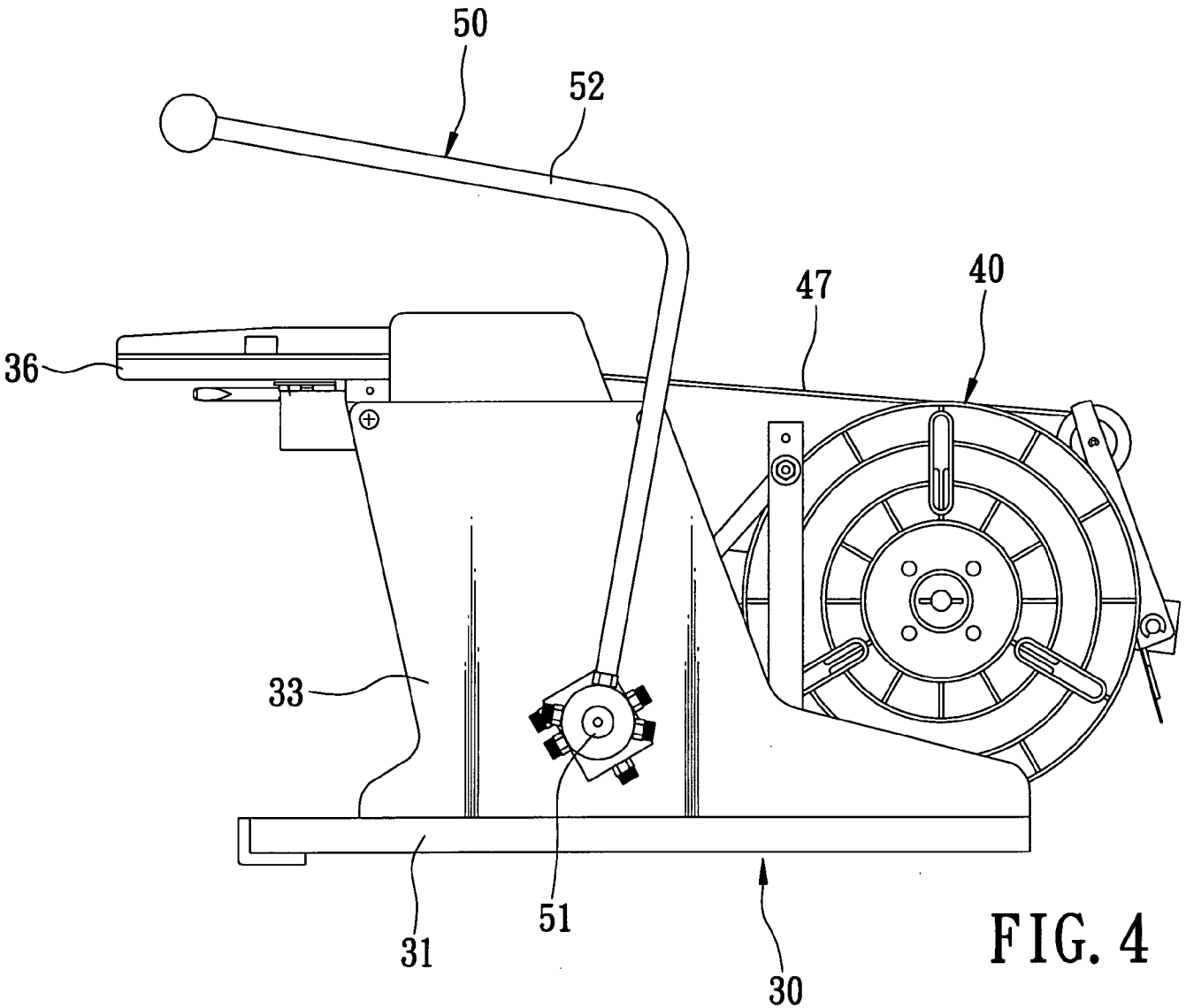
FIG. 4 is another side view of the tying machine of FIG. 3.

Referring again to FIG. 8 in combination with FIG. 3, the advancing unit 60 includes a driven shaft 61 which is disposed rotatably between and extends through the upper support 36 and the partition plate 37, a wire drawing roller 62 sleeved on the driven shaft 61 within the upper support 36, a wire pinching roller 63 mounted rotatably in the upper support 36 in contact with the wire drawing roller 62, and a toothed driven wheel 67 mounted on the driven shaft 61 on top of the partition plate 37. A toothed compound wheel 68 engages the toothed driven wheel 67 on top of the partition plate 37.

Figure 9:
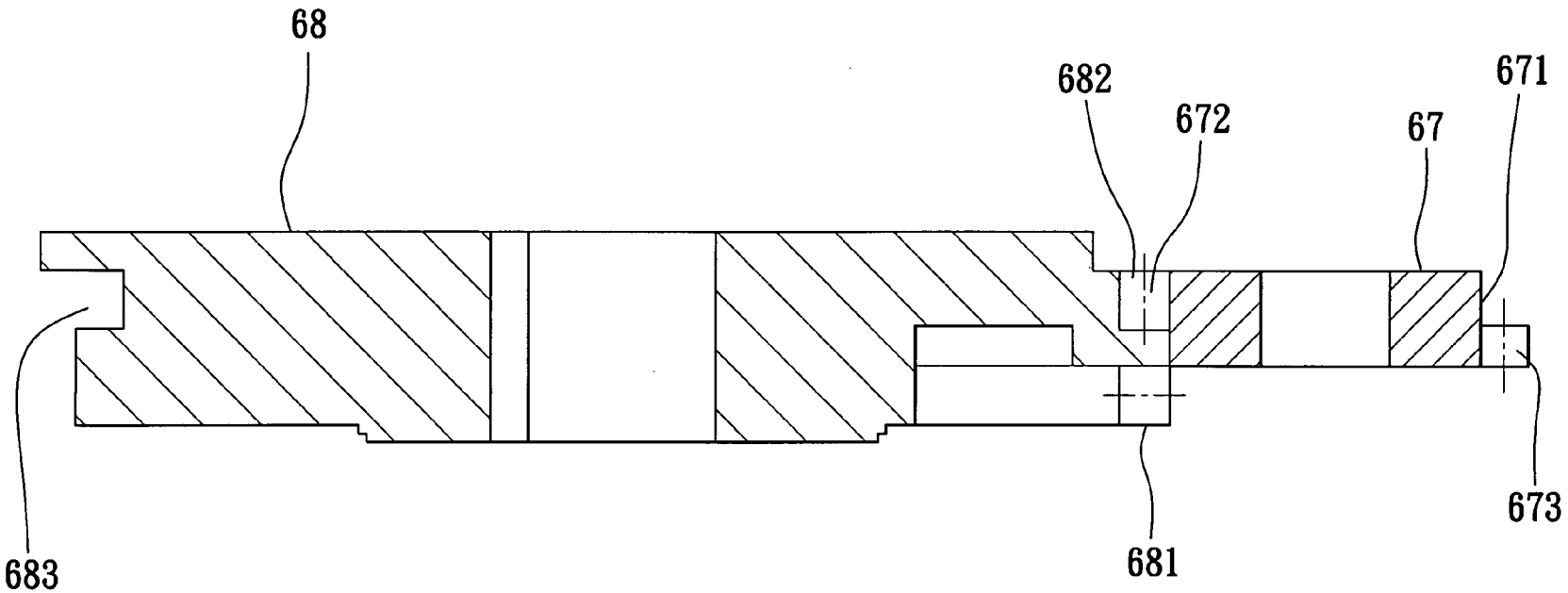
FIG. 9 is a sectional view showing a tooth compound wheel and a driven wheel of the tying machine.

Referring to FIG. 9 in combination with FIG. 8, the toothed driven wheel 67 has a tooth-free planar face 671 formed in the periphery of the driven wheel 67. The planar face 671 extends axially and downwardly from the top end of the driven wheel 67 so that the periphery of the driven wheel 67 is divided circumferentially into a thick upper toothed part 672 and a thin lower toothed part 673. The lower toothed part 673 extends angularly by an angle of 360 degrees, whereas the upper toothed part 672 extends angularly by an angle of less than 360 degrees.

The toothed compound wheel 68 is mounted rotatably on the rotary shaft 551. The toothed compound wheel 68 has a bottom toothed part 681 formed at the bottom side thereof and a lateral toothed part 682 formed in the circumferential surface thereof. A circumferential groove 683 is formed in the circumferential surface of the toothed compound wheel 68 and extends radially inward from the circumferential surface. The lateral toothed part 682 extends angularly by an angle of less than 180 degrees and engages the upper toothed part 672 of the driven wheel 67 so as to rotate the driven wheel 67, the driven shaft 61 and the wire drawing roller 62 simultaneously. The circumferential groove 683 receives the lower toothed part 673 when the lateral toothed part 682 disengages from the upper toothed part 672 so that the driven wheel 67 is not rotated by the toothed compound wheel 68. This arrangement is provided for intermittent advancement of the wire 47.

Figure 10:
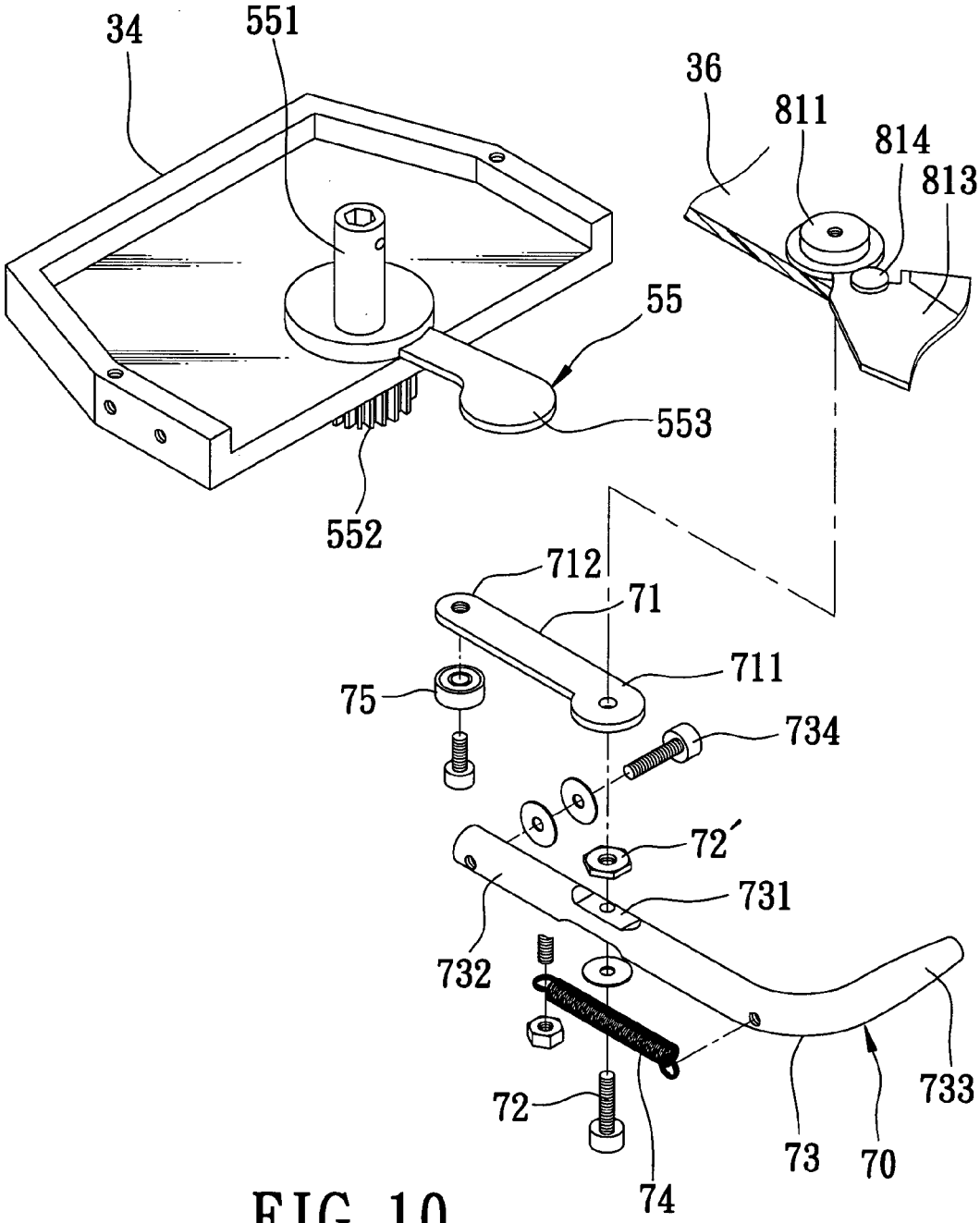
FIG. 10 is an exploded view showing a wire bending unit of the tying machine.

Referring to FIG. 10 in combination with FIG. 6, the constricting unit 70 includes a lever 71 and a hook-like arm 73 both of which are mounted rotatably on the bottom side of the upper support 36 by means of a locking spindle 72. The locking spindle 72 passes sequentially through the hook-like arm 73, a nut 72' received in a recess 731 of the hook-like arm 73, one end 711 of the lever 71, the upper support 36, and a rotary member 811 which will be explained hereinafter. A contact roller 75 is attached to the other end 712 of the lever 71 and contacts the cam member 553. A headed screw 734 is attached to one end 732 of the hook-like arm 73 to contact the contact roller 75. A returning spring 74 is connected to a distal hook end 733 and the bottom side of the upper support 36.

Referring once again to FIGS. 6, 8 and 9, the tying mechanism 80 includes a wire bending unit 81, a wire cutting unit 82 and a wire twisting unit 83 all of which are conventional and are actuated by the rotary shaft 551. The wire cutting unit 82 cuts the wire 47. The wire bending unit 81 bends the wire 47 around an article 90 such as an open part of a bag received in the recess 39 of the machine body 30. The wire twisting unit 83 serves to receive and twist two ends of a cut segment of the wire 47.

The wire twisting unit 83 has a fixing block 831 fixed to the upper support 36, a twisting rod 832 extending through the fixing block 831 in a front-to-rear direction, a gear 833 attached to a rear end of the twisting rod 832 and engaging the bottom toothed part 681 of the toothed compound wheel 68, and a twisting hook 834 disposed at a front end of the twisting rod 832.

Referring once again to FIGS. 8 and 10, the wire bending unit 81 includes a hook-like arm 812, a guide piece 813 which has a sleeve end fitted around the rotary member 811 that in turn is sleeved on the locking spindle 72, a post 814 provided on the guide piece 813, and a returning spring (extension spring) 815 connected between the guide piece 813 and the upper support 36. The hook-like arm 812 can be moved toward the recess 39 when the guide piece 813 turns along with the rotary member 811 and the locking spindle 72, and the spring 815 serves to return the guide piece 813.

The wire cutting unit 82 includes a passage 821 formed in a guide block 822 fixed in the upper support 36 proximate to the wire outlet 363, and a cutter 824 which has a cutting edge 823 and which is connected to the post 814 disposed on the guide piece 813. The cutter 824 is therefore actuated by the guide piece 813 through the post 814 to move through the passage 821 so as to cut the wire 47.

When the operating member 52 is turned rearward manually, the following operations occur:

Firstly, the drive shaft 51 rotates and moves the link mechanism 53. The rack member 54 is thus moved rearward.

Secondly, when the rack member 54 moves, it rotates the single direction gear 552, the rotary shaft 551, the cam member 553 and the toothed compound wheel 68. Due to the engagement of the lateral toothed part 682 of the toothed compound wheel 68 with the driven wheel 67, the driven wheel 67 is driven, thereby rotating the driven shaft 61, the wire drawing roller 62 and the wire pinching roller 63 to advance the wire 47 toward the recess 39.

Thirdly, the cam member 553 rotates and moves the contact roller 75 of the constricting unit 70, thus turning the hook-like arm 73 and the locking spindle 72 and moving the distal hook end 733 of the hook-like arm 73 toward the recess 39. The distal hook end 733 constricts the open part of the bag 90 received in the recess 39 of the upper support 36.

Furthermore, the rotational movement of the locking spindle 72 is transmitted to the rotary member 811 and the guide piece 813 so that the hook-like arm 812 of the wire bending unit 81 is moved toward the recess 39 and bends the wire 47 around the open part of the article 90. At the same time, the cutter 824 of the wire cutting unit 82 is moved toward the wire 47 and cuts the same. The two ends of the cut segment of the wire 47 are received by the twisting hook 834. The continued rearward movement of the rack member 54 causes the bottom toothed part 681 of the toothed compound wheel 68 to drive the gear 833 of the wire twisting unit 83 and rotate the twisting rod 832, thereby twisting the cut wire 47.

Moreover, the continued rearward movement of the rack member 54 causes the lateral toothed part 682 of the toothed compound wheel 68 to disengage from the driven wheel 67 and results in an extension of the lower toothed part 673 into the circumferential groove 683 of the toothed compound wheel 68. At this time, the driven wheel 67 does not rotate although rotation of the toothed compound wheel 68 still proceeds.

On the other hand, after the cam member 553 pushes the lever 71, further rotation of the rotary shaft 551 will cause the cam member 553 to move away from the lever 71. At this juncture, the lever 71 will be urged by the returning spring 74 toward its original position.

When the operating member 52 is released, the drive shaft 51 returns to its original position by virtue of the action of the returning spring 56, thus moving the link mechanism 53 and the rack member 54 to their original positions. At this state, the rotation of the single direction gear 53 will reverse and idle so that no movement is transmitted to the rotary shaft 551 and the cam member 553.

In case malfunctions occur in the link mechanism 53 and the rack member 54, the operations thereof may be reversed by turning the operating member 52 forward to rectify the malfunctions. Due to the use of the single-direction gear 552, the reverse operation of the link mechanism 53 and the rack member 54 does not result in any movement of the wire bending unit 81, the wire cutting unit 82 and the wire twisting unit 83.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A tying machine for tying an article, comprising:

a machine body having a recess adapted to receive a portion of the article;

a wire reel mounted on said machine body and having a wire wound around said wire reel;

an advancing unit mounted on said machine body for advancing said wire toward said recess;

a wire bending unit mounted on said machine body and including a hook-like arm which is movable toward said recess so as to bend said wire around the article, or movable away from said recess;

a wire cutting unit mounted on said machine body for cutting said wire;

a wire twisting unit mounted on said machine body for twisting said wire after said wire is bent;

an operating member mounted on said machine body;

a drive shaft connected to said operating member so as to be rotated thereby;

a link mechanism connected to said rotary shaft;

a rack member connected to and driven by said link mechanism; and a transmission unit including a rotary shaft, a single-direction gear sleeved around said rotary shaft for simultaneous rotation therewith, and a cam member mounted on and driven by said rotary shaft, said single-direction gear being engaged with and driven by said rack member, wherein said wire bending unit, said wire cutting unit, and said wire twisting unit are connected to and driven by said cam member.

2. The tying machine as claimed in claim 1, wherein said machine body includes two spaced apart side walls, a top wall interconnecting said side walls, and an upper support disposed on top of said top wall and projecting forwardly from a front end of said top wall, said wire reel being mounted on said machine body rearwardly of said top wall, said recess being formed in a front end of said upper support.

3. The tying machine as claimed in claim 2, wherein said drive shaft has two ends mounted respectively on said side walls, said operating member being connected to one of said ends of said drive shaft outwardly of one of said side walls.

4. The tying machine as claimed in claim 3, wherein said machine body further has a slide groove which is confined by a groove wall and which is provided on the bottom side of said top wall, said rack member being received in said slide groove.

5. The tying machine as claimed in claim 4, wherein said rack member includes a first side formed with a plurality of rack teeth, a second side, and rollers incorporated into said rack member and projecting from said second side to be in sliding contact with said groove wall.

6. The tying machine as claimed in claim 3, wherein said wire cutting unit, said wire twisting unit and said wire bending unit are disposed on top of said upper support.

7. The tying machine as claimed in claim 6, wherein said rotary shaft of said transmission unit extends through said top wall and said upper support and are connected to said wire cutting unit, said wire twisting unit and said wire bending unit, said rotary shaft having a lower end extending downwardly from said top wall adjacent to said rack member, said single-direction gear being sleeved around said lower end of said rotary shaft.

8. The tying machine as claimed in claim 3, further comprises a returning spring which is associated with said drive shaft.

9. The tying machine as claimed in claim 7, wherein said link mechanism includes a first link connected to and rotated by said drive shaft, a second link having opposite first and second ends, said first end being connected pivotally to said first link, said link mechanism further including third and fourth links each having first end connected pivotally to said second end of said second link, said third link further having a second end pivoted to said machine body between said side walls, said fourth link further having a second end pivoted to said rack member.

10. The tying machine as claimed in claim 9, further comprising a constricting unit which includes a hook-like arm that is movable toward said recess to constrict the article, and a returning spring which urges said hook-like arm of said constricting unit to move away from said recess, said hook-like arm of said constricting unit being driven by said cam member, said constricting unit being mounted on a bottom side of said upper support.

11. The tying machine as claimed in claim 1, wherein said advancing unit is connected to and actuated by said rotary shaft.

* * * * *